United States Patent [19]

Koch

[11] 4,299,000

[45] Nov. 10, 1981

[54] METHOD FOR THE PRODUCTION OF THREADED NUTS BY COLD FORMING

[75] Inventor: Friedrich-Karl Koch, Krefeld, Fed. Rep. of Germany

[73] Assignee: Peltzer & Ehlers, Krefeld, Fed. Rep. of Germany

[21] Appl. No.: 68,719

[22] Filed: Aug. 22, 1979

Related U.S. Application Data

[63] Continuation of Ser. No. 867,481, Jan. 6, 1978, abandoned.

[30] Foreign Application Priority Data

Jan. 7, 1977 [DE] Fed. Rep. of Germany ..... 2700546

[51] Int. Cl.[3] ..... B21D 53/24; B21K 1/68

[52] U.S. Cl. ..... 10/86 F

[58] Field of Search ..... 10/72 R, 74, 75, 76 R, 10/86 R, 86 F, 152 R; 29/517

[56] References Cited

U.S. PATENT DOCUMENTS

| | | | |
|---|---|---|---|
| 1,957,922 | 5/1934 | Wilcox | 10/86 F |
| 1,970,430 | 8/1934 | Nussbaum | 10/76 R |
| 1,977,162 | 10/1934 | Wilcox | 10/86 F |
| 2,015,596 | 9/1935 | Harvey et al. | 10/85 |
| 2,547,801 | 4/1951 | Wilcox | 10/86 F |
| 2,689,360 | 9/1954 | Ware | 10/86 F |
| 2,751,676 | 6/1956 | Kaul | 10/76 R |
| 2,870,465 | 1/1959 | Kraus et al. | 29/517 X |
| 2,994,952 | 8/1961 | Klooz | 10/86 F |
| 3,793,658 | 2/1974 | Ladouceur | 10/86 F |

FOREIGN PATENT DOCUMENTS

| | | | |
|---|---|---|---|
| 1003148 | 11/1951 | France | 10/76 R |

*Primary Examiner*—Ervin M. Combs

*Attorney, Agent, or Firm*—Shlesinger, Arkwright, Garvey & Dinsmore

[57] ABSTRACT

A method for the preparation of hexagonal nuts by cold forming wherein a blank is shaped and formed to a hexagonal configuration wherein the distances across the flats of the hexagon are greater than in the finished nut, and thereafter the rough nut is forced into a shaping die and over a punch concentric therewith, whereby the punch forms the central opening in the nut and the shaping die reduces the distances across the flats of the hexagon to that of the final nut size.

2 Claims, 8 Drawing Figures

FIG. 1a
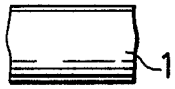
FIG. 1b
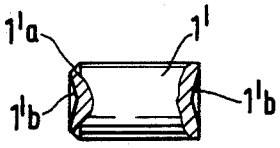
FIG. 1c
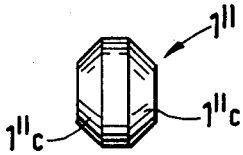
FIG. 1d
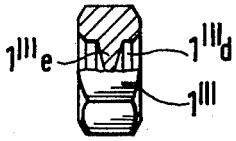
FIG. 1e
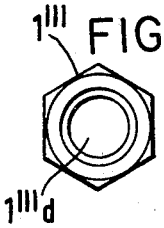
FIG. 1f
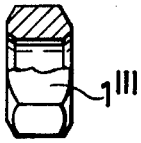
FIG. 1g
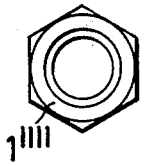
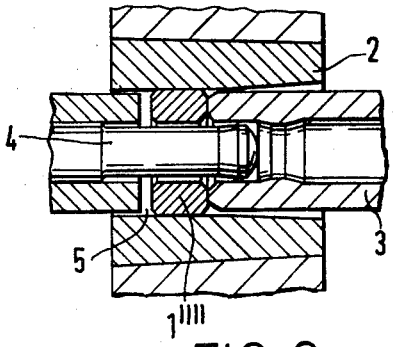
FIG. 2

METHOD FOR THE PRODUCTION OF THREADED NUTS BY COLD FORMING

This is a continuation of application Ser. No. 867,481, filed Jan. 6, 1978, abandoned.

The invention relates to a method for the production of threaded nuts by cold forming, in particular hex nuts where a blank is pressed in several stages. The invention relates in particular to a method in which the blank is chamfered and planed in a first press stage, pressed into a round with bevels on both sides in a second press stage, the nut being prepressed and prepunched in a third stage and finish punched in a fourth stage.

Since the material used, most usually steel, flows very poorly in colf forming, the stamping must be turned over repeatedly in the known method to obtain an unobjectionable and sharp-edged nut blank. It is precisely the turning over which requires a complicated transfer mechanism within the multiple stage press.

It is an object of the invention to provide a method for the production of threaded nuts by cold forming which requires no turning over of the blank or of the rough nut during the production cycle in the various press stages.

This problem is solved in that the rough nut is prepressed with greater dimensions across the flats than in the final nut in one stage and punched in the next stage to be subsequently reduced to finished size across the flats in the same stage.

As far as the four-stage method described at the outset is concerned, in which the blank is chamfered and planed in a first stage, pressed into a round with bevels on both sides in a second stage, the rough nut then being prepressed and prepunched on both sides in a third stage and finish punched in a fourth stage, the rough nut is to be prepressed with greater dimensions across the flats than in the final nut in the third stage and punched in the fourth stage to be subsequently reduced to finished size in the same stage.

It is obvious that the prepressing of the nut with oversize across the flats leaves so much surplus material that material to form clean chamfers, bevels and corners is available for the reduction of the nut to its finished size. Another advantage is seen in that the tool to produce the rough nut with oversize across the flats may have radiused corners, i.e. it need not have sharp edges. This increases tool life considerably.

The invention is illustrated in the drawing by way of a plan of the stages and a schematic, sectioned view of the fourth press stage with reference to the accompanying drawings.

FIGS. 1*a*–1*g* are schematic representations of the first stages of the method of this invention; and FIG. 2 is a cross-sectional view of a shaping die and punch used in the final step of the method.

The so called O-stage, as shown in FIG. 1*a*, represents the cut-off blank 1. In the first press stage, as shown in FIG. 1*b*, this blank 1 is planed in one operation into the stamping 1′, chamfered 1′*a* on one side and slightly precupped 1′*b* on both sides.

In the second press stage, as shown in FIG. 1*c*, likewise in one operation, the so called round 1″ is pressed so as to provide bevels 1″*c* on both sides. The diameter of the round corresponds roughly to the subsequent nut size across the flats.

In the third press stage, as shown in FIGS. 1*d* and 1*e*, again in one operation, i.e. without turning over, the rough nut 1‴ is prepressed to a larger size across flats than that of the finished nut 1⁗. In the sketch shown, for instance, the size across flats is 19.1 mm. In addition, the rough nut is prepunched 1‴*d* in this third press stage so that only an inner core 1‴*e* remains.

Lastly, in the fourth press stage, as shown in FIGS. 1*f* and 1*g*, the rough nut 1‴ is first punched through and subsequently reduced to the finished size across flats in the same stage. In the example shown, this is 18.8 mm.

The fourth press stage is shown schematically in detail in FIG. 2. As usual, it has a die 2 into which and over the punch 4 the rough nut 1‴ is pushed by means of the so called inner core ejector tube 3. The inner core—not shown—is ejected in the process and can be removed through the inner core ejector tube 3.

As the rough nut 1‴ continues to be pushed into the die 2 it reaches the calibrating zone 5 in which the width across the flats is reduced to the desired size and calibrated with sharp corners so that substantially simultaneously in the same press stage the rough nut is punched and finished sized.

In another operation which, however, does not belong to the cold forming within the multiple stage press used for the method described above, the required thread is then cut into the nut hole.

What is claimed is:

1. A method for the production of hexagonal nuts by cold forming comprising providing a round blank, shaping said blank by pressure to form a rough nut having a hexagonal configuration wherein the distances across the flats of the hexagon are greater than in the finished nut, finish-sizing said rough nut by forcing said rough nut into a shaping die and over a punch concentrically located in a fixed position within said die to substantially simultaneously punch a central opening in said rough nut using said punch and to reduce the distances across the flats of the hexagon to final size by compressing said rough nut in said shaping die.

2. In a method for the production of hexagonal nuts by chamfering and planing a blank, pressing said blank so as to form a round blank having bevels on opposite faces thereof, pre-pressing and pre-punching said opposite faces so as to form a hexagonal rough nut, and finish punching said rough nut, the improvement comprising pre-pressing and pre-punching said blank so that said rough nut has greater distances across the flats of the hexagon than the finished nut, and forcing said roughnut into a shaping die and over a punch concentrically located in a fixed position within said die to substantially simultaneously punch a central opening in said rough nut using said punch to reduce the distances across the flats of the hexagon to final size by compressing said rough nut in said shaping die.

* * * * *